US007975435B2

(12) United States Patent
Lenney et al.

(10) Patent No.: US 7,975,435 B2
(45) Date of Patent: Jul. 12, 2011

(54) RAIN GUTTER DEBRIS PRECLUSION DEVICE

(76) Inventors: Robert C. Lenney, Newcastle, CA (US); John R. Lewis, Modesto, CA (US)

( * ) Notice: Subject to any disclaimer, the term of this patent is extended or adjusted under 35 U.S.C. 154(b) by 573 days.

(21) Appl. No.: 12/004,141

(22) Filed: Dec. 19, 2007

(65) Prior Publication Data

US 2008/0163561 A1 Jul. 10, 2008

Related U.S. Application Data

(63) Continuation-in-part of application No. 10/944,167, filed on Sep. 16, 2004, now Pat. No. 7,310,912.

(60) Provisional application No. 60/503,610, filed on Sep. 16, 2003.

(51) Int. Cl.
*E04D 13/00* (2006.01)

(52) U.S. Cl. ..... 52/12; 52/11; 52/15

(58) Field of Classification Search ..... 52/11, 12, 52/15; 248/48.1, 48.2; 210/474
See application file for complete search history.

(56) References Cited

U.S. PATENT DOCUMENTS

| | | | | |
|---|---|---|---|---|
| 672,701 | A | 4/1901 | Daniel | |
| 1,732,058 | A * | 10/1929 | Martini | 210/474 |
| 2,229,381 | A | 1/1941 | Grow | |
| 2,288,121 | A | 6/1942 | Sandmeyer | |
| 2,583,422 | A | 1/1952 | Haddon | |
| 4,646,488 | A | 3/1987 | Burns | |
| 4,745,710 | A | 5/1988 | Davis | |
| 4,949,514 | A | 8/1990 | Weller | |
| 5,010,696 | A * | 4/1991 | Knittel | 52/12 |
| 5,044,581 | A * | 9/1991 | Dressler | 248/48.1 |
| 5,107,635 | A | 4/1992 | Carpenter | |
| 5,261,195 | A | 11/1993 | Buckenmaier | |
| 5,398,464 | A * | 3/1995 | Jacobs | 52/12 |
| 5,406,754 | A | 4/1995 | Cosby | |
| 5,617,678 | A | 4/1997 | Morandin | |

(Continued)

FOREIGN PATENT DOCUMENTS

JP 09228592 9/1997

(Continued)

OTHER PUBLICATIONS

Preferred Distributing, Inc.; "How it Works" Section of LeafFilter Web Site and Photographs of the LeafFilter Gutter Protection Product; www.leaffilter.com; Unknown Date Plainwell, MI.

*Primary Examiner* — Brian E Glessner
*Assistant Examiner* — Adam Barlow

(57) ABSTRACT

A barrier is provided to preclude debris from passing into a rain gutter. The barrier includes a screen supported upon a channel. The channel includes a tab positionable between a roof and shingles upon the roof, and with a lip opposite the tab resting upon a portion of a gutter opposite the roof. The channel includes a recess between the tab and the lip. The recess includes a floor defining a lower plane of the channel. Ribs extend from the floor up to an upper plane of the channel in which the screen is supported. The ribs have sufficient height to remain in contact with the screen. Water is drawn through the screen and along the ribs down to the floor of the recess. Apertures in the floor allow the water to fall down through the channel and into the gutter, while debris is precluded from passing through the screen.

9 Claims, 7 Drawing Sheets

U.S. PATENT DOCUMENTS

| | | | | |
|---|---|---|---|---|
| 5,640,809 | A | 6/1997 | Iannelli | |
| 5,729,931 | A | 3/1998 | Wade | |
| 6,134,843 | A | 10/2000 | Tregear | |
| 6,205,715 | B1 | 3/2001 | Rex | |
| 6,598,352 | B2 * | 7/2003 | Higginbotham | 52/12 |
| 6,942,419 | B2 | 9/2005 | Knak | |
| 6,951,077 | B1 | 10/2005 | Higginbotham | |
| 7,624,541 | B2 * | 12/2009 | Gentry | 52/12 |
| 2005/0279036 | A1 * | 12/2005 | Brochu | 52/287.1 |

FOREIGN PATENT DOCUMENTS

| | | |
|---|---|---|
| KR | 1989-10803 | 7/1989 |
| KR | 1989-23083 | 12/1989 |
| KR | 1998-16228 | 6/1998 |

* cited by examiner

PLAIN WEAVE

TWILL WEAVE

PLAIN DUTCH WEAVE

FIVE HEDDLE WEAVE

RAIN GUTTER DEBRIS PRECLUSION DEVICE

CROSS-REFERENCE TO RELATED APPLICATIONS

This application is a continuation-in-part of U.S. patent application Ser. No. 10/944,167, filed on Sep. 16, 2004 now U.S. Pat. No. 7,310,912, which claims benefit under Title 35, United States Code §119(e) of U.S. Provisional Application No. 60/503,610 filed on Sep. 16, 2003.

FIELD OF THE INVENTION

The following invention relates to barriers for rain gutters and similar structures for keeping leaves and other debris out of the rain gutters. More particularly, this invention relates to rain gutter debris preclusion barriers which utilize a screen to allow water to pass into the gutter, but to preclude debris from passing into the gutter.

BACKGROUND OF THE INVENTION

Keeping rain gutters free of debris is a common nuisance for home owners. When debris such as leaves, shingle residue, and other material collect within a rain gutter, the rain gutter is prone to becoming clogged and ceasing to function to carry water in a desirable fashion off of the roof and away from the building. Not only is the process of cleaning gutters of such debris a nuisance, it also entails significant risk of injury, particularly when the rain gutters are elevated high above the ground.

To remedy this undesirable situation, numerous products have been developed to keep debris from collecting within a rain gutter, so that the cleaning of the gutters can be avoided. For representative sampling of such prior inventions, see U.S. Pat. Nos. 4,646,488 (Burns), U.S. Pat. No. 4,745,710 (Davis), U.S. Pat. No. 4,949,514 (Weller), U.S. Pat. No. 5,010,696 (Knittel), U.S. Pat. No. 5,261,195 (Buckenmaier), U.S. Pat. No. 5,640,809 (Iannelli), U.S. Pat. No. 6,134,843 (Tregear) and U.S. Pat. No. 6,598,352 (Higginbotham).

Some such prior art gutter debris guards utilize some form of screen which allows water to pass through but precludes debris. Such screen-based gutter debris guards present a difficult technical problem. If the apertures in the screen are too large, then debris will pass through the openings in the screen, causing the device to fail. If the openings are slightly smaller, the debris can become lodged within the apertures themselves, plugging up the apertures and providing a homeowner with a new challenge involved in cleaning debris out of the screen itself. Also, if the openings are large, the screen must either be of very high strength material, or be subject to bending or other collapse when a large amount of debris is located upon the screen. At the other extreme, if the openings are too small, surface tension forces in the water will cause a film of water to span the openings in the screen and the water will roll across the screen and not pass through the screen into the gutter. With such fine mesh screens, water is thus not adequately allowed to pass through the screen and water spills over the gutters, preventing the gutter from functioning at all.

The patent to Higginbotham (U.S. Pat. No. 6,598,352) teaches one solution to this problem. In particular, the screen is supported from below by a series of vertical legs that extend up to elliptical heads which support the screen thereon. With the elliptical heads of the legs in contact with the screen, adhesion forces in the water are beneficially utilized to provide a wetted path of surface material wicking the water down through the screen along these legs where the water is then further allowed to drop down into the gutter.

While the Higginbotham skeletal support structure with included screen supporting legs is generally effective, it exhibits some drawbacks which have been addressed by this invention. In particular, the skeletal structure including the legs and included ellipses is rather complex in form. It is not easily attached to rain gutters, and is not conveniently formed for supporting the included screen. Also, Higginbotham teaches use of multiple structures together underlying the screen, rather than utilizing a simplified single structure to support the screen and assist in drawing the water through the screen and into the gutter. Higginbotham is attached to the gutter only, rather than between the roof and the gutter. Such attachment results in more difficult installation.

SUMMARY OF THE INVENTION

This invention provides a rain gutter debris preclusion barrier which satisfies the aforementioned need for a rain gutter debris preclusion barrier. Particularly, a channel is provided for placement over at least a portion of a rain gutter and which supports a screen upon the channel. The channel is configured to rest along one edge between a roof and shingles upon the roof, and at another edge adjacent a portion of a gutter spaced from a roof, such that the channel need only be attached at the edge adjacent the front of the gutter. The channel is preferably formed of a single constant cross-sectional structure with a recess below portions of the channel abutting the gutter and the roof. Ribs extend up from a floor of the recess to an upper plane in which the screen is located. The ribs are thus available to draw water through the screen by providing a wetted surface for capillary action forces to assist in drawing water through fenestrations in the screen and down to the floor of the channel. Apertures in the channel are provided with sufficient size to allow the water collecting on the floor to drop through the apertures and into the rain gutter.

OBJECTS OF THE INVENTION

Accordingly, a primary object of the present invention is to provide a barrier for preventing debris from passing into a rain gutter, while allowing water to pass into the rain gutter.

Another object of the present invention is to provide a rain gutter debris barrier which traps very small debris before the debris passes into the rain gutter, while allowing water to pass into the rain gutter.

Another object of the present invention is to provide a rain gutter debris barrier which covers the entire rain gutter.

Another object of the present invention is to provide a rain gutter debris preclusion device which is easy to install in a highly secure fashion.

Another object of the present invention is to provide a rain gutter debris barrier which is of high strength and durable in performance.

Another object of the present invention is to provide a rain gutter debris barrier which resists deterioration when exposed to direct sunlight and extremes of temperatures.

Another object of the present invention is to provide a rain gutter debris barrier which is easy to manufacture.

Another object of the present invention is to provide a method for precluding debris from a rain gutter which operates reliably and minimizes an amount of gutter maintenance for a homeowner.

Other further objects of the present invention will become apparent from a careful reading of the included drawing figures, the claims and detailed description of the invention.

DESCRIPTION OF THE PREFERRED EMBODIMENT

Figure 1:
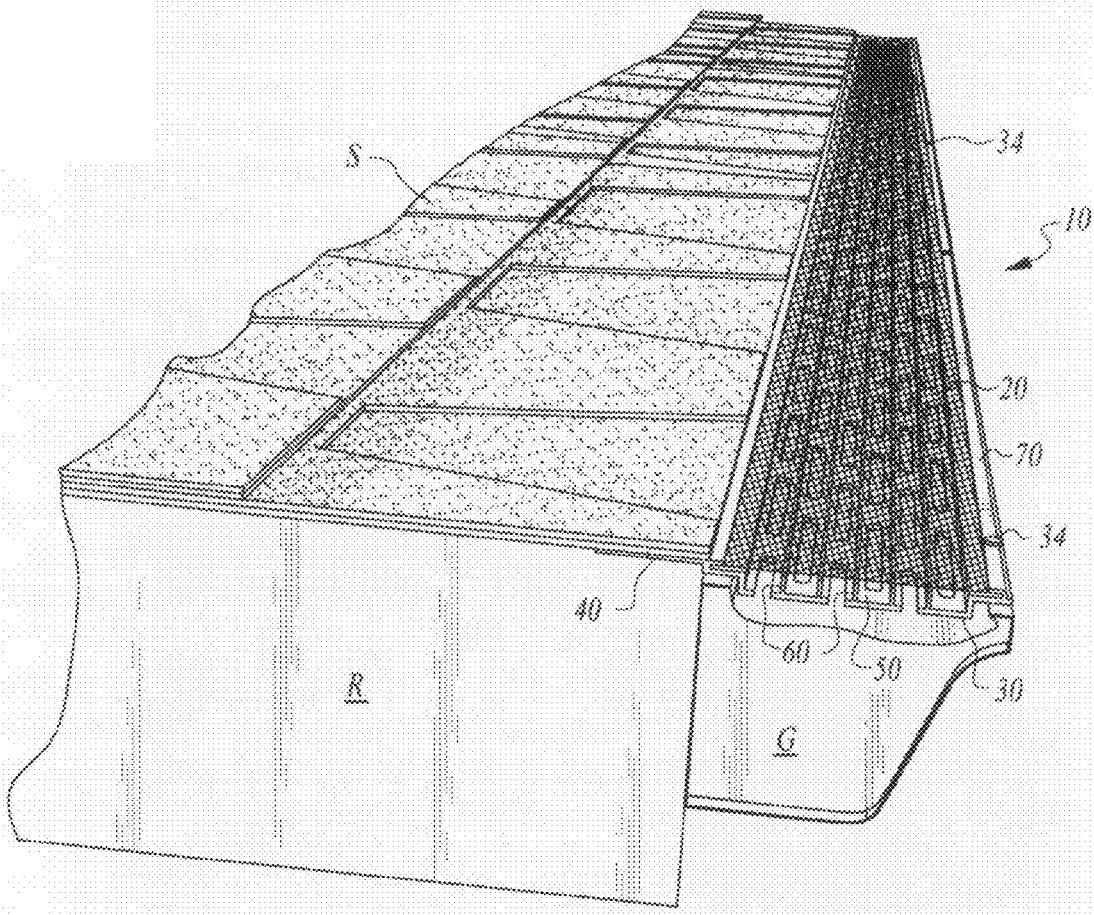
FIG. 1 is a perspective view of a roof with a rain gutter mounted thereon and with the rain gutter debris preclusion device of this invention mounted upon the gutter and the roof.

Referring to the drawings, wherein like reference numerals represent like parts throughout the various drawing figures, reference numeral 10 (FIGS. 1 and 2) is directed to a barrier for preclusion of debris from a rain gutter G mounted upon a roof R. Water W traveling off of shingles S upon the roof R pass onto a screen 20 of the barrier 10. A channel 30 is located beneath the screen 20 and supports the screen 20 in position while also drawing the water W through the screen 20 and into the channel 30 for further delivery down into the rain gutter G. Any debris falling off of the shingles S and onto the screen 20 of the barrier 10 either remain upon the barrier 10 or fall off of the screen 20 and away from the gutter G so that the gutter G can remain free of debris and functioning properly.

Figure 2:
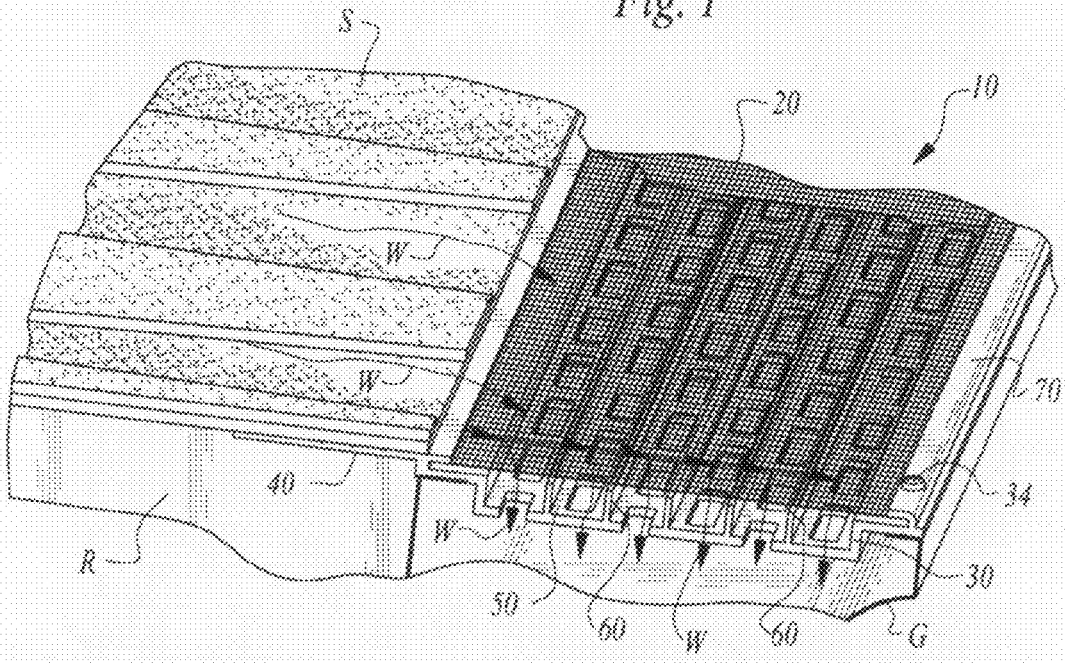
FIG. 2 is a detail of a portion of that which is shown in FIG. 1 with arrows indicating a path followed by water passing off of the roof and through the barrier into the rain gutter.

In essence, and with particular reference to FIGS. 1 and 2, the basic details of the barrier 10 of this invention are described. The barrier 10 is comprised of two parts including the screen 20 and the channel 30. The screen 20 precludes debris from passing into the gutter G (FIG. 1) while allowing the water W (FIG. 2) to pass into the gutter G. The channel 30 is provided to support the screen 20 in the desired position and orientation for the screen 20. The channel 30 also functions to draw the water W through the screen 20 by capillary action so that the water W desirably passes into the gutter G.

The channel 30 includes a tab 40 at an upper end. The tab 40 preferably fits directly between the shingles S and the felt or other vapor barrier upon the roof R, so that an upper side of the channel 30 is supported in the desired position overlying the gutter G. For convenience, the roof R is considered to include all portions of the covering of a building except for the shingles S. The shingles S are considered to include the uppermost layer of material, and can be "composite" shingles, tile, wood shake, slate, stone, or any other roofing material available to provide the uppermost layer. A recess 50 defines a portion of the channel 30 adjacent the tab 40. The recess 50 includes a floor 56 defining a lowermost portion of the channel 30. A series of ribs 60 extend up from the floor 56 of the recess 50 to support the screen 20 in the desired position above the floor 56 of the recess 50. A lip 70 defines an edge of the channel 30 opposite the tab 40. The lip 70 is adapted to be secured to a portion of the gutter G most distant from the roof R, such as with a screw 34 or other fastener.

Figure 3:
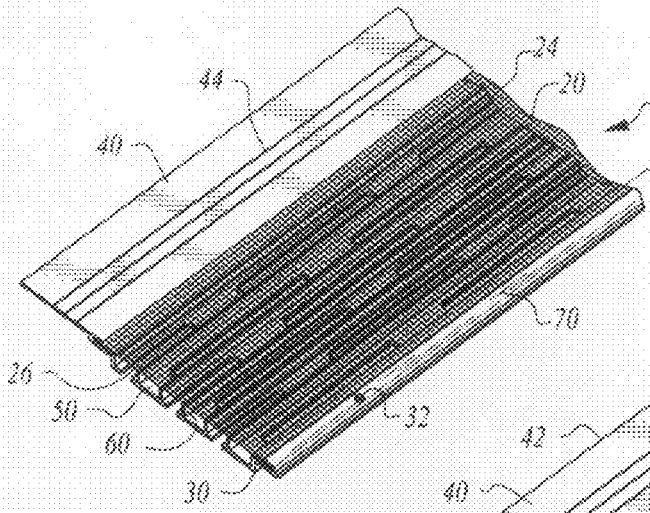
FIG. 3 is a perspective view of a portion of the rain gutter debris preclusion device of this invention alone.

More specifically, and with particular reference to FIGS. 1-3, details of the screen 20 of the barrier 10 are described. The screen 20 can be any form of fenestrated structure capable of allowing water to pass therethrough but blocking debris from passing therethrough. The screen 20 is preferably formed of a flexible material with uniformly sized fenestrations. Most particularly, this screen 20 is formed of stainless steel woven wire with the fenestrations in the screen 20 sized to provide approximately 8,000 holes per square inch. With such small fenestrations, twigs, sand and leaf stems are precluded from sticking in the fenestrations, and practically all debris harmful to the proper functioning of the gutter G is precluded from passing therethrough.

The screen 20 includes a lower edge 22 parallel with and spaced from an upper edge 24. The edges 22, 24 are spaced apart by a distance similar to a width of the gutter G away from the roof R of a structure. The screen 20 includes side edges 26 extending between the lower edge 22 and upper edge 24 at ends of sections of the barrier 10. Typically the barrier 10 is provided in separate sections for convenience in covering rain gutters G of various different lengths.

FIGS. 1-3 show fenestrations in the screen 20 larger than actually preferred, so that the fenestrations can be clearly seen. Most preferably, the fenestrations are smaller than those shown in the drawings. Alternatively, a screen 20 with larger fenestrations can be utilized, particularly in environments where the debris to be precluded is not susceptible to becoming lodged in such larger fenestrations, or where higher flows can lead to screen 20 blockage with debris, such as roof valleys.

Figure 4:
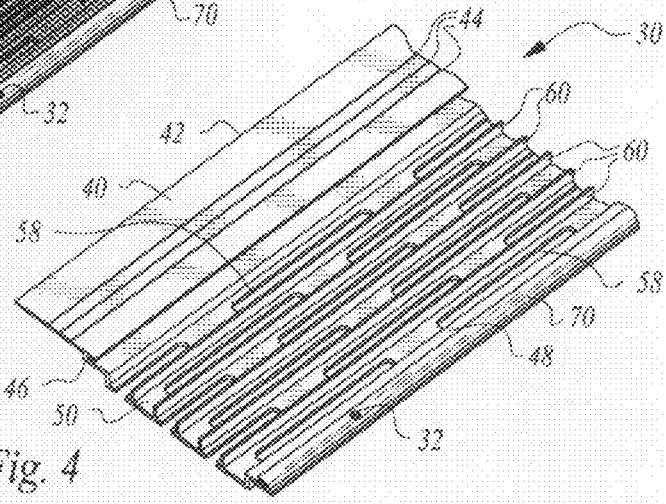
FIG. 4 is a perspective view of the channel portion of the rain gutter debris preclusion device of this invention.
Figure 5:
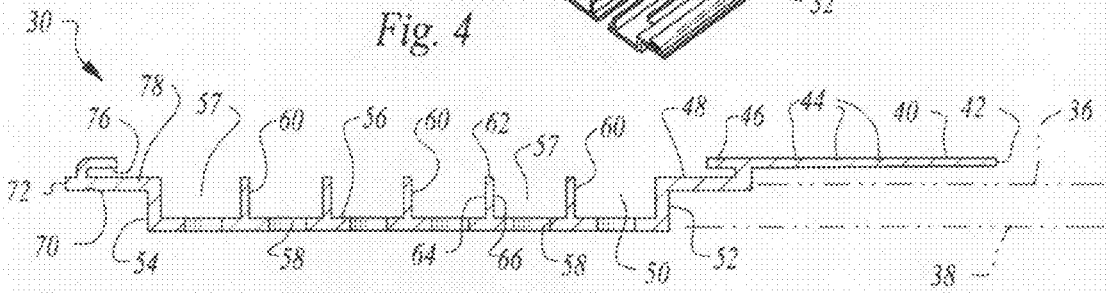
FIG. 5 is a full sectional view of that which is shown in FIG. 4.
Figure 6:
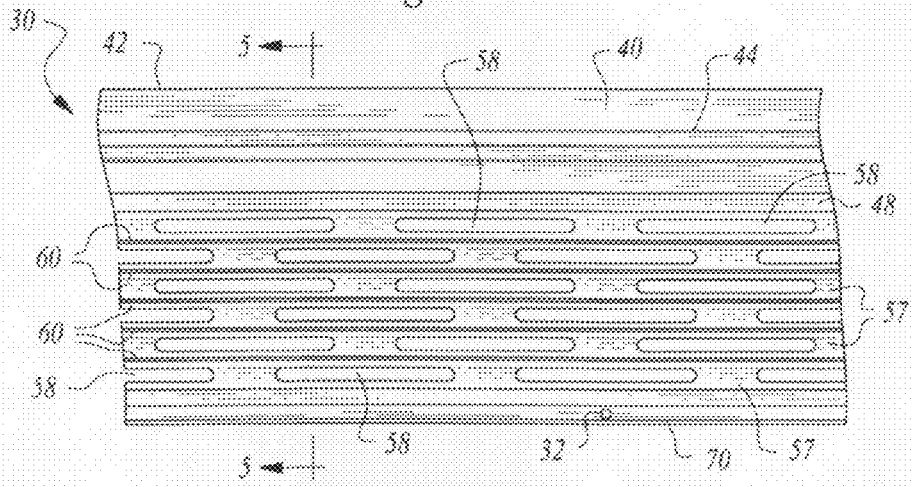
FIG. 6 is a top plan view of that which is shown in FIG. 4.

With particular reference to FIGS. 4-6, details of the channel 30 of the barrier 10 are described. The channel 30 provides a rigid underlying structure for supporting the screen 20 where desired over the gutter G, and for encouraging water W migration through the screen 20 by capillary action. The channel 30 also provides for mounting of the barrier 10 upon the gutter G and roof R. Particularly, mounting holes 32 are preferably provided along a forward edge of the channel 30. Screws 34 (FIGS. 1 and 2), such as sheet metal screws, can pass through the mounting holes 32 and be threaded into a portion of the gutter G most distant from the roof R. The barrier 10 is thus securely held in position over the gutter G.

The channel 30 is preferably shaped to have a constant cross-sectional form. Preferably, the channel 30 is formed of rigid die extruded aluminum. The channel 30 has most of the material thereof aligned with either an upper plan 36 or a lower plane 38 (FIG. 5) which are preferably parallel and spaced from each other.

A tab 40 extends in a planar fashion near, but slightly above the upper plane 36 and is adapted to be located closest to the roof R. This tab 40 secures a portion of the channel 30 opposite where the mounting holes 32 and screws 34 are utilized to fasten to the gutter G. Particularly, the tab 40 is adapted to fit between the roof R and shingles S to secure one side of the channel 30. Between the tab 40 and the screws 34, the barrier 10 is securely held in place over the gutter G.

The tab 40 includes a tip 42 which defines a portion of the channel 30 most distant from the mounting holes 32. The tip 42 also defines a width of the tab 40. Preferably, this tab 40 width is sufficient to cause the tab 40 to be securely held just beneath the shingles S. Typically, this distance is at least one centimeter and most preferably two to three centimeters. The tab 40 includes notches in surfaces thereof, to increase the ability of the tab 40 to be shortened, if the tab 40 is excessively wide.

The tab 40 is shown extending parallel with other portions of the channel 30 generally. If a particularly steeply pitched roof is provided, it is conceivable that the tab 40 could be bent so that it is oriented in a plane distinct from other portions of the channel 30. Alternatively, the tab 40 can be shortened or entirely removed to accommodate steeply pitched roofs.

The tab 40 includes a tab slot 46 for supporting the upper edge 24 of the screen 20. The tab slot 46 is closed on three sides (when viewed such as in FIG. 5), with one open side in the tab slot 46. The open side of the tab slot 46 faces a lip slot 76 adapted to hold the lower edge 22 of the screen 20 (described in detail below). An upper shelf 48 defines one side of the tab slot 46 below the tab slot 46 which extends further than other portions of the slot 46 and within the upper plane 36. This upper shelf 48 supports a portion of the screen 20, and discourages buckling of the screen 20 in a downward fashion when loaded with debris or otherwise encountering forces which would tend to drive the screen 20 downwardly.

The recess 50 defines a portion of the channel 30 extending between the tab 40 and the lip 70 which is below the upper plane 36 and extending down to the lower plane 38. The upper plane can generally be defined as including the tab slot 46 and the lip slot 76 (described in detail below). The recess 50 includes an upper wall 52 and a lower wall 54 on opposite sides of the recess 50. Each of the walls 52, 54 extend from the upper plane down to the lower plane.

A floor 56 is aligned with the lower plane 38 and extending between lower portions of the walls 52, 54. The floor 56 and lower plane are preferably parallel with the upper plane so that a constant spacing is maintained for the recess 50 between the floor 56 and a position where the screen 20 lies between the tab slot 46 and the lip slot 76.

The floor 56 includes a plurality of apertures 58 passing therethrough. These apertures 58 are preferably elongate with a significantly greater length than width and with a length thereof extending parallel with a long axis of the channel 30. The floor 56 is broken up into a plurality of troughs 57 between adjacent ribs 60. Each of the troughs 57 preferably include a plurality of apertures 58 therein. Preferably, the apertures 58 are closer to a rib 60 on a lower side of each trough 57 than a rib 60 on an upper side of each trough 57. Because the entire lower plane and upper plane are tilted such that the tab 40 is elevated above the lip 70, locating of the apertures 58 closer to the ribs 60 on the lower side of the trough 57 decreases the possibility of puddling of water within the troughs 57.

The apertures 58 are sufficiently large so that no degree of surface tension in the water W can tend to cause a film to span the apertures 58 which might otherwise preclude water W migration through the apertures 58. Thus, once water W is within the troughs 57 and adjacent a floor 56, the water quickly passes through the apertures 58 to drip off of a lower surface of the recess 50 of the channel 30.

A plurality of ribs 60 extend up from the floor 56 of the recess 50, with the ribs 60 extending from the lower plane 38 up to the upper plane 36. Each of the ribs 60 includes a free end 62 adjacent the upper plane 36 and a base end 64 connected to the floor 56. Each of the ribs 60 preferably include sides 66 which are planar from the base end 64 up to the free end 62.

The free end 62 is preferably generally thin with the free ends 62 supporting the screen 20 over the recess 50 and the channel 30. Not only do the ribs 60 support the screen 20 so that the screen 20 can remain within the upper plane 36, but the ribs 60 also provide a wetted path between the screen 20 and the floor 56 so that capillary action can draw water W (FIG. 2) from the upper surface of the screen 20, down through the fenestrations in the screen 20 to the surfaces of the ribs 60 and then on down to the floor 56 where the water W can pass through the apertures 56 and fall down off of the recess 50 of the channel 30 and into the gutter G. Preferably, the ribs 60 are each of a similar height and each of a similar width and extend perpendicularly between the lower plane 38 at the floor 56 to the upper plane 36 adjacent the screen 20.

The lower wall 56 of the recess 50 transitions into the lip 70 of the channel 30. The lip 70 supports the mounting holes 32 and screws 34 (FIGS. 1 and 2) for securing the channel 30 to the gutter G. The lip 70 extends to a tip 72 defining a portion of the channel 30 most distant from the tab 40. The lip slot 76 is a mirror image of the tab slot 46 and is located within the upper plane 36 facing the tab slot 46. A lower shelf 78 extends between the lip slot 76 and the lower wall 54 of the recess 50. The lower shelf 78 further supports a portion of the screen 20 adjacent the lip slot 76 to discourage the screen 20 from being deflected downward into the recess 50.

The slots 46, 76 preferably have sufficient depth so that the lower edge 22 and upper edge 24 of the screen 20 can be securely held within the slots 46, 76 without requiring fastening of the screen 20 within the slots 46, 76. A sealant or other adhesive is preferably used to further secure the screen 20 within the slots 46, 76. Alternatively, the screen 20 can be fastened within the slots 46, 76 or otherwise fastened to the channel 30, such as through adhesive, fasteners, welding, brazing, pressing the slots 46, 76 closed onto the screen 20 or other coupling techniques.

In use and operation, and with particular reference to FIGS. 1 and 2, details of the installation and use of the barrier 10 of this invention are described. Initially, the barrier 10 is installed upon the gutter G. Particularly, lengths of the barrier 10 are placed over the gutter G with the lip 70 resting upon a forward edge of the gutter G. Screws 34 or other fasteners are utilized to secure the lip 70 to the gutter G. Before the screws 34 are utilized, the tab 40 is slid between the shingles S and the roof R. If necessary, the tab 40 can be removed to accommodate a steeply pitched roof R and then transition to allow the remaining portions of the channel 30 to extend over the gutter G to the lip 70 where the lip 70 supports the screw 34 for fastening of the channel 30 to the gutter G.

At ends of the gutter G, excess portions of the barrier 10 can be cut utilizing a saw for cutting of the aluminum and scissors or other cutting tools for cutting of the material forming the screen 20. Where outside corners are encountered in the gutter G, the channel 30 can be cut at a 45° angle. At inside corners, most preferably the screen 20 is replaced with a screen having larger fenestrations. Most preferably, such an alternative screen would have no less than sixteen fenestrations per inch in each direction (256 per square inch). In this way, the greater concentration of debris tending to gather at inside corners will not block the screen 20. Alternatively, other forms of joints can be utilized to position the barrier 10 where desired at inside and outside corners over corresponding bends in the gutter G.

Between linear sections of barriers 10, a seam 80 extends from the tabs 40 to the lips 70. Preferably, this joint is covered to preclude debris entrapment at this joint. Particularly, a finger 90 of thin aluminum can be slid into the slots 46, 76 of each barrier 10 to cover the screens 20 where edges thereof on adjacent barriers 10 come together. A similar covering is also preferably provided at outside corner joints between adjacent barriers 10, that is often called a thumb at such outside corners, and has a similar configuration as the fingers 90. Such fingers 90 also help to interlock adjacent barriers 10 together. At ends of the gutters G, end caps are provided to cover the screen 20 edge and preclude debris and insects from getting under the screen 20 and/or the barrier 10.

Details of the finger 90 and its use in covering the seam 80 and joining separate sections of the barrier 10 are further described with reference to FIGS. 7-13. The barrier 10 preferably comes in discrete sections so that the screen 20 ends at ends 21 and the channel 30, providing a preferred form of support structure for the barrier 10, also ends at ends 31. These ends 21, 31 preferably end at a common area defined by the seam 80. The seam 80 is spanned by a finger 90 as described further below.

The finger 90 is preferably a generally rectangular thin piece of flexible aluminum, but could alternatively be formed of other materials. This thin piece of aluminum is substantially planar except as specifically described herein. The finger 90 thus extends between opposite ends 92 to define a longest dimension and between sides 94 extending between the ends 92. The ends 92 are spaced apart a distance slightly greater than a distance between slots 46, 76 in the channel 30. The ends 92 are sufficiently thin so that they can be inserted into the slots 46, 76 above the screen 20 to both cover the seam 80 and secure the separate sections of channel 30 and seam 20 for the separate barrier 10 sections, to couple them tightly and securely together.

Figures 7, 8, 9, 10:
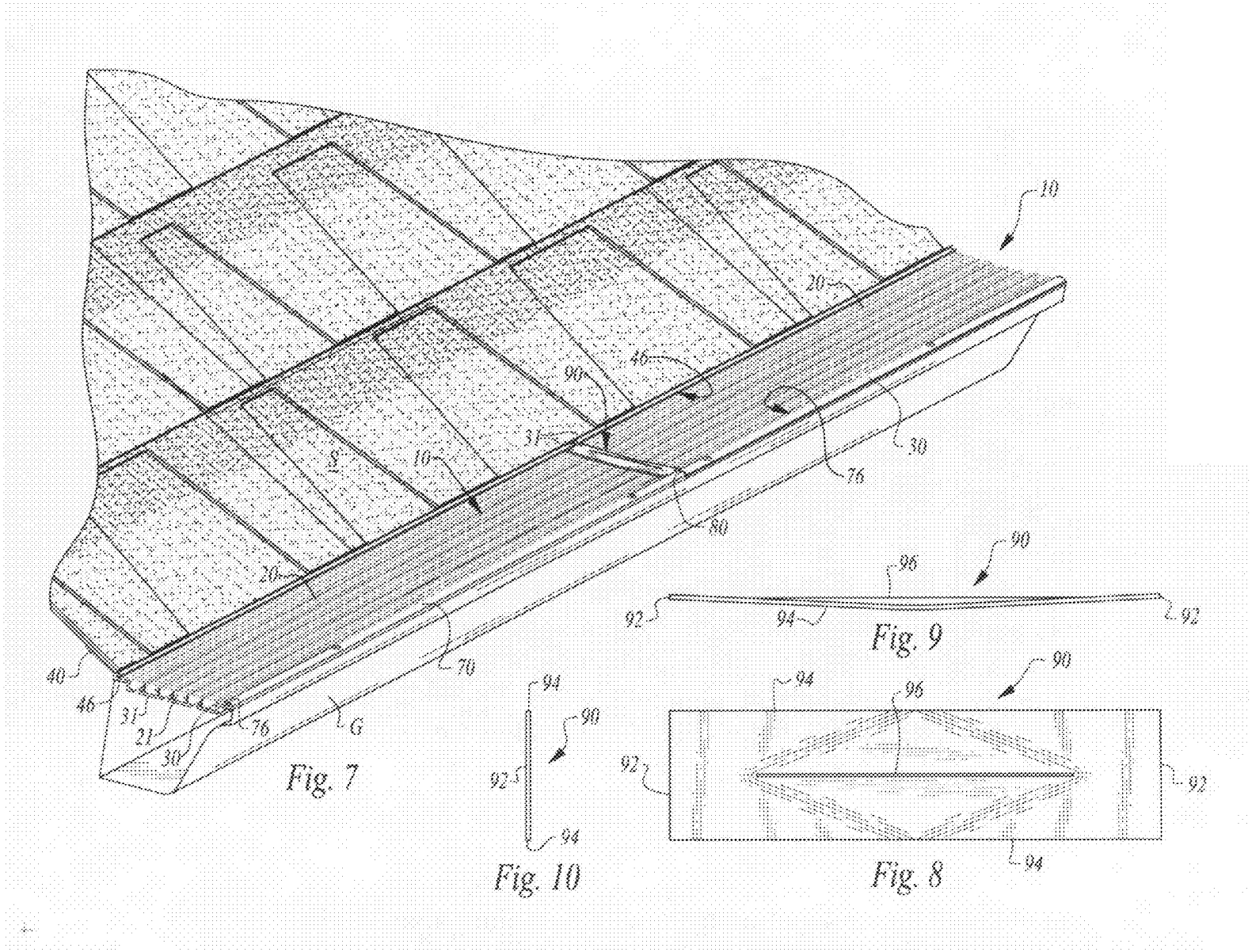
FIG. 7 is a perspective view of the barrier of this invention shown in multiple separate sections with a seam therebetween and with the seam covered by a connecting member in the form of a finger to both cover the seam and join the separate sections of barrier material together.
FIG. 8 is a top plan view of the finger depicted in FIG. 7.
FIG. 9 is a front elevation view of that which is shown in FIG. 8.
FIG. 10 is a side elevation view of that which is shown in FIG. 8.

The finger 90 preferably includes a ridge 96 extending along a portion of a central long axis thereof. This ridge preferably extends substantially linearly along a central long axis of the finger 90 extending between the ends 92. The sides 94 preferably sag downward between the ends 92 slightly while the ridge 96 remains linear (FIG. 9). This contour of the finger 90 provides the finger 90 with slightly more rigidity even though it is formed from a thin piece of somewhat flexible aluminum. As an alternative, the finger 90 could be entirely flat with no ridge.

Figure 12:
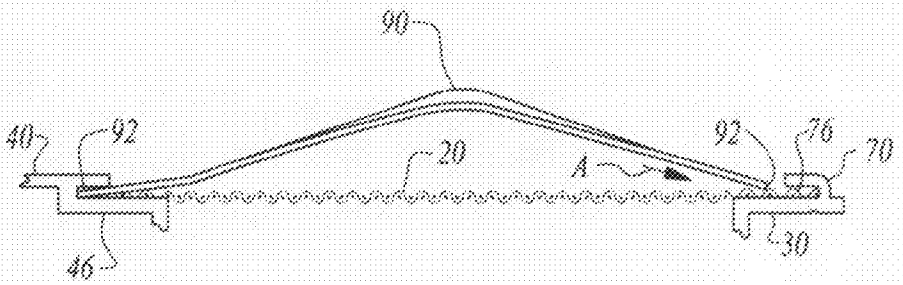
FIG. 12 is a sectional view of a portion of that which is shown in FIG. 11 and shown during the process of flexing the finger to insert the finger into slots in the channel forming the support structure.
Figure 13:
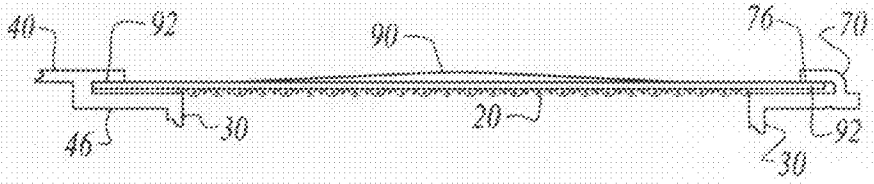
FIG. 13 is a sectional view similar to that which is shown in FIG. 12, but after the finger has been fully inserted into opposing slots.
Figure 11:
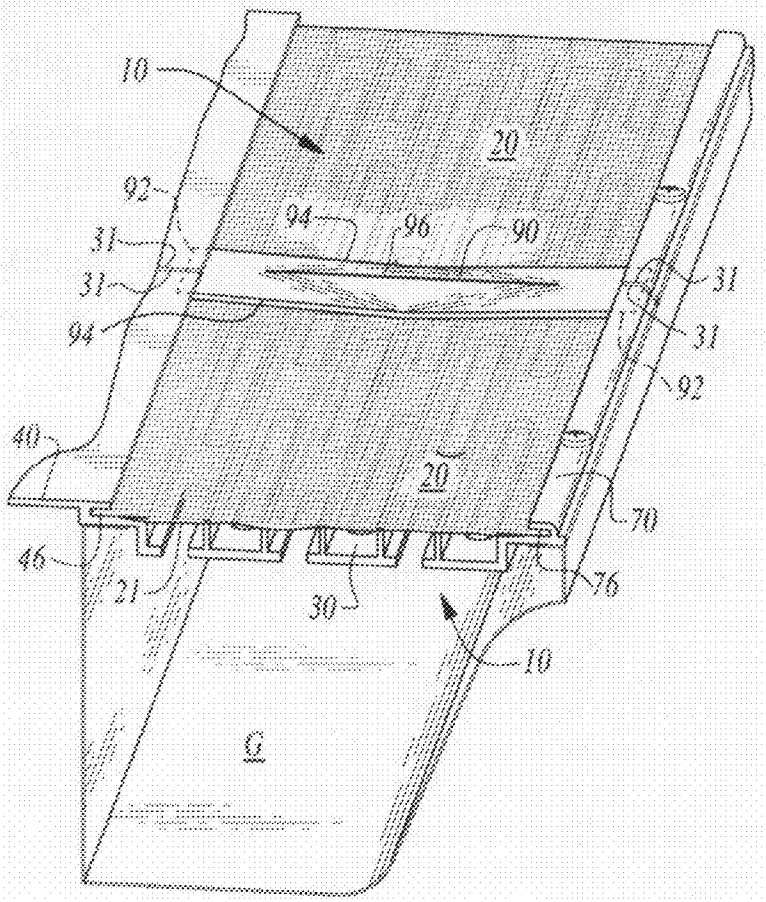
FIG. 11 is a perspective view providing a detail of a portion of that which is shown in FIG. 7 and illustrating how the finger fits over the screen and support structure of the barrier.

To insert the finger 90 into the slots 46, 76, the finger 90 is first bent (FIG. 12). One of the ends 92 is then inserted into the slot 46. The other end 92 is then extended into the slot 76 (along arrow A of FIG. 12). The finger 90 is then pushed down to both extend the ends 92 into the slot 76 and slot 46 and to flatten the finger 90, until the finger 90 is entirely flat and adjacent the screen 20, and extending fully into each of the slots 46, 76 (FIG. 13). If the seam 80 is at a corner in the gutter G and barrier 10, the seam could be formed by cutting a 45° angle in the channel 30 and screen 20 on each adjacent barrier 10 section. Another option is to run the barrier 10 longer from one side of the corner than the other, to fill up the corner. Most preferably, outside corners of the gutter G are covered with the mitering technique with both barriers cut at a 45° angle and inside corners of the gutter G are covered with the longer barrier 10 and shorter barrier 10 abutment technique. The finger 90 would then be aligned with a long axis thereof aligned with this beveled seam 90.

Figure 14:
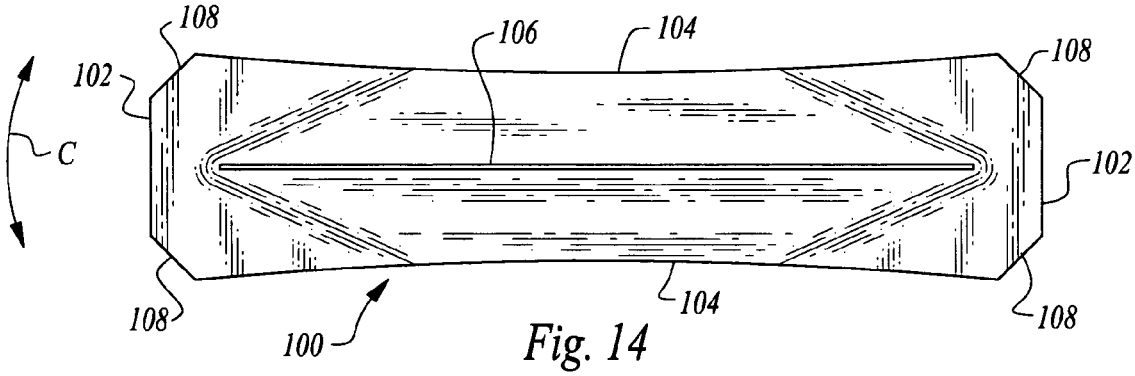
FIG. 14 is a top plan view of an alternative finger.

With particular reference to FIGS. 14-17, details of a narrow finger 100 are described. This narrow finger 100 is similar to the finger 90 described above except that it is narrower between opposing sides 104 and would typically have a similar length between ends 102. This narrow finger 100 is also depicted with beveled corners 108. Such beveled corners 108 could be provided on the finger 90 of the preferred embodiment also, and facilitate insertion of the narrow finger 100 into the slots 46, 76 (FIG. 11) utilizing more of a diagonal placement and then rotation to cover the seam 80 procedure, rather than the bending procedure (depicted in FIG. 12). Such diagonal rotation is depicted by arrow C (FIG. 14).

Figure 17:
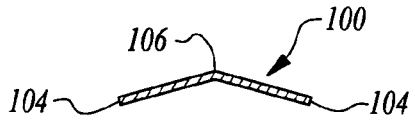
FIG. 17 is a sectional view taken along lines 17-17 of FIG. 15.
Figure 16:
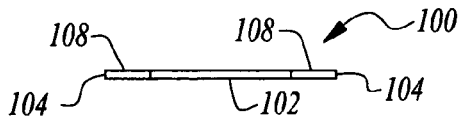
FIG. 16 is an end elevation view of that which is shown in FIG. 14.
Figure 15:
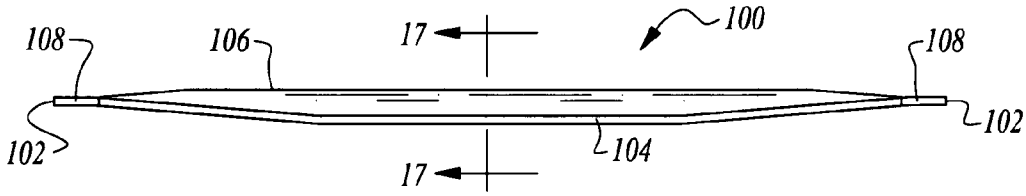
FIG. 15 is a front elevation view of that which is shown in FIG. 14.

The narrow finger 100 also preferably includes a ridge 106 which is more pronounced than that of the finger 90. The narrow finger 100 preferably begins having a substantially constant width between the ends 102. After the ridge 106 is formed, however, the sides 104 end up being closer together at a midpoint than they are at the ends 102. A cross-section at a midpoint thereof is shown in FIG. 17. In this embodiment depicted in FIGS. 14-17, the ridge 106 is actually slightly above a plane in which the ends 102 are located. Also, the sides 104 taper down below this plane between the ends 102 at a midpoint thereof.

Figure 19:
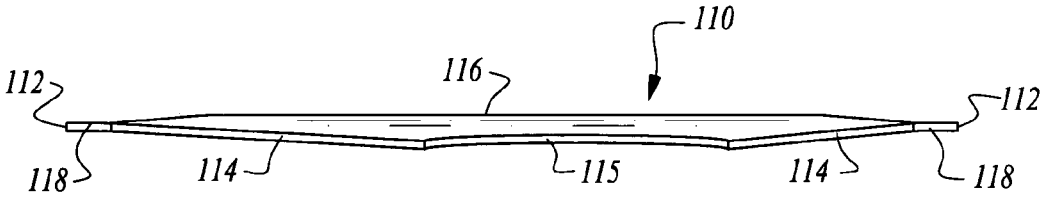
FIG. 19 is a front elevation view of that which is shown in FIG. 18.
Figure 18:
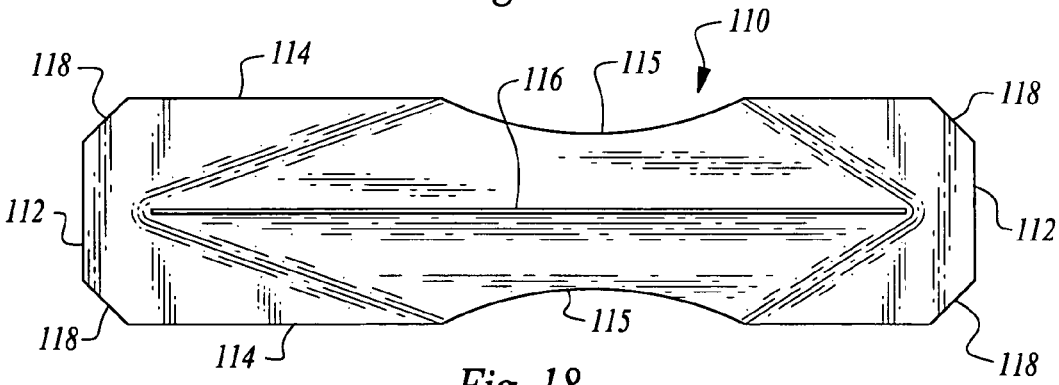
FIG. 18 is a top plan view of another alternative embodiment finger.

With particular reference to FIGS. 18 and 19, details of a contoured finger 110 are described. The contoured finger 110 includes opposite ends 112 defining a longest dimension of the contoured finger 110 and with sides 114 extending between the opposite ends 112. The sides 114 preferably each include a recessed edge 115 near a midpoint thereof to cause the contoured finger 110 to be narrower at a midpoint thereof. This helps to cause the contoured finger 110 to more easily be flexed near a midpoint thereof then near ends 112 thereof, such that the ends 112 remain substantially planar for insertion into the slots 46, 76. This finger 110 also preferably includes a ridge 116 and beveled corners 118, but could alternatively be entirely flat and/or have sharp corners rather than beveled corners 118.

Figure 21:
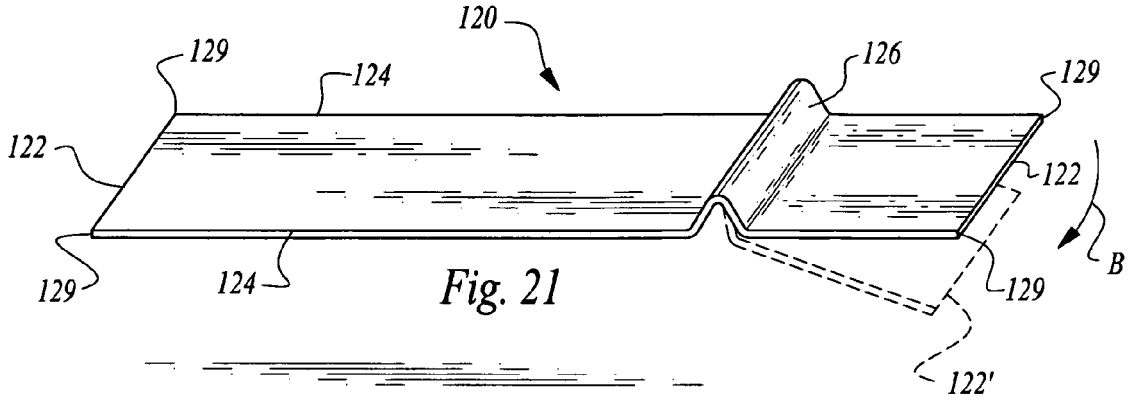
FIG. 21 is a perspective view of that which is shown in FIG. 20.
Figure 20:
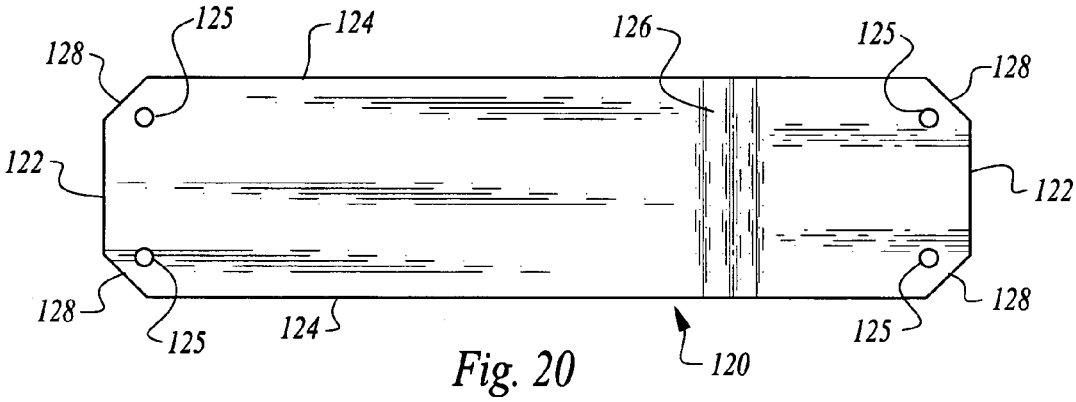
FIG. 20 is a top plan view of another alternative embodiment finger.

With particular references to FIGS. 20 and 21, details of a winged finger 120 are described. The winged finger 120 is preferably substantially planar and has a long axis extending between the ends 122 and a width defined by sides 124 extending between the ends 122. The winged finger 120 uniquely includes a wing 126 in the form of three bends in the material forming the winged finger 120. These bends cause the wing 126 to exhibit an inverted "V" cross-sectional form. Portions of the winged finger 120 on either side of the wing 26 are preferably in a common plane with each other.

The winged finger 120 can have beveled corners 128 or square corners 129 (FIG. 21). The winged finger 120 could also optionally include holes 125. These holes 125 are also depicted in FIG. 9. The holes allow a fastener to pass through the finger and then can pass through the screen 20 and through the channel 30 to secure the finger. Most preferably, securing of the finger occurs by providing a friction fit into the slots 46, 76. Utilization of fasteners through the holes, such as the holes 125 can either augment this friction fit or provide for attachment in embodiments where no friction fit exists between the finger and the screen 20. These holes 125 are shown with the winged finger 120 but could be provided similarly in any of the other finger embodiments of this invention.

The holes 125 could optionally be located closer to the ends 122 or the slots 46, 76 deep enough that the holes 125 would line up with corresponding holes in the slots 46, 76 also. Such an arrangement helps to secure the finger, such as the winged finger 120 to the channel 30. While holes 125 facilitate screws or other elongate mechanical fasteners (i.e. nails, rivets, bolts, etc.), other fasteners could also conceivably be used including staples, adhesive or other fasteners.

While the fingers preferably pass into the slots 46, 76, if some fastening system other than friction fit into the slots 46, 76 is utilized, the fingers could be shorter and not pass into the slots 46, 76. The fingers would cover the seam 80 and use the fastening system to join adjacent elongate sections of the barrier together.

The winged finger 120 is preferably formed from a resilient material, such as spring steel. The winged finger 120 can thus be flexed about the wing 126 (depicted by lowering of the end 122' in phantom along arrow of FIG. 21). Flexing facilitates insertion of the ends 122 into the slots 46, 76.

The wing 126 on the winged finger 120 also beneficially provides a barrier to prevent water from passing entirely over the winged finger 120 and avoid passing into the gutter G. Rather, as water passes from the end 122 most distant from the wing 126, it abuts the wing 126. The water is then diverted laterally by the wing 126 onto portions of the screen 20 on either side of the winged finger 120. The water then passes through the screen 120 and into the gutter G. The wing 126 is located closer to an end 122 of the finger 120 that is adjacent the lip 30. In this way, sufficient portions of the winged finger 120 are still available for flexing and insertion into the lip slot 46, while minimizing a portion of the winged finger 120 upon which water can land and pass over the lip of the gutter G, rather than passing through the screen 20 after being diverted by the wing 126.

Figure 23:
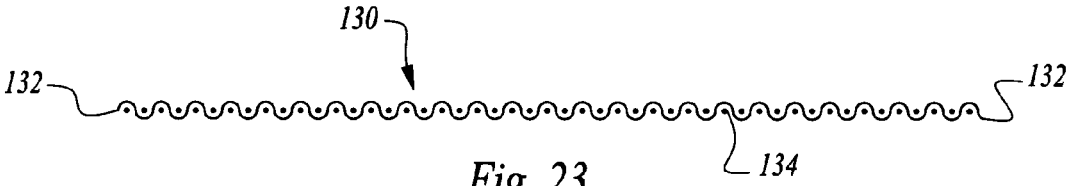
FIG. 23 is a front elevation view of that which is shown in FIG. 22.
Figure 22:
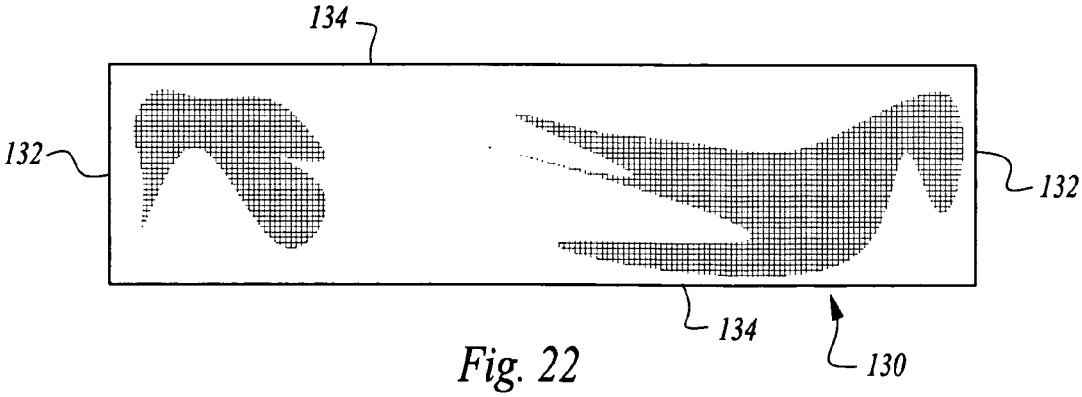
FIG. 22 is a top plan view of another alternative embodiment finger in the form of a section of screen material.

With particular reference to FIGS. 22 and 23, details of a screen finger 130 are described. The screen finger 130 is generally rectangular with a similar contour to the finger 90. The screen finger 130 thus includes ends 132 at opposite ends thereof and sides 134 extending between the ends 132. The screen finger 130 has the ends 132 inserted into the slots 46, 76 with a friction fit provided therein to secure the screen finger 130 to the screen 20 and cause separate sections of the barrier 10 to be joined together. The screen finger 130 has the advantage of allowing water to pass therethrough so that no zone is presented where water could avoid passing into the gutter.

Figure 24:
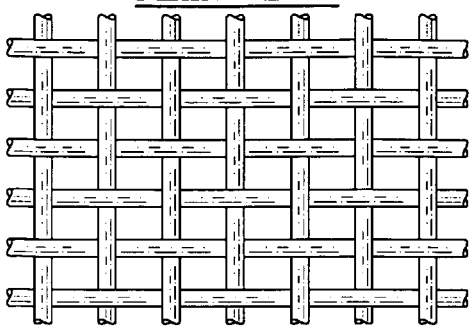
Fig. 24 (Prior Art)
FIGS. 24-31 depict various weave patterns for the screen portion of the barrier of this invention.
Figure 26:
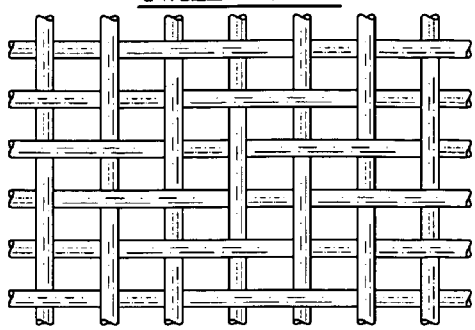
Figure 25:
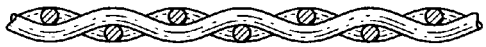
Fig. 25 (Prior Art)
Figure 27:
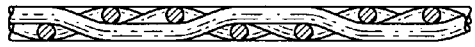
Figure 28:
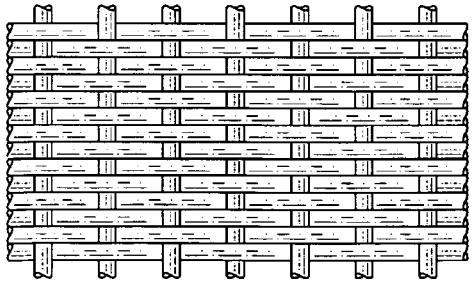
Figure 30:
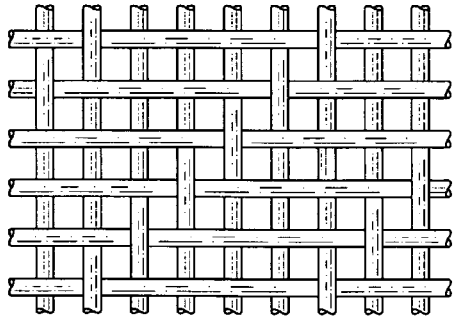
Figure 29:
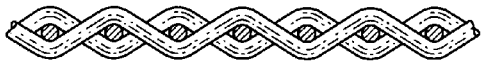
Figure 31:
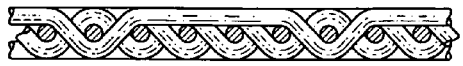

FIGS. 24-31 show various different weave patterns for the screen 20. The screen 20 is preferably formed of 316L stainless steel but could be a different alloy of stainless steel or some other material. Prior art screens 20 have only used a plain weave (FIG. 24). These other weaves have benefits as follows:

The plain weave with each warp wire going over and under the successive weft wires and vice versa ensuring the maximum of weaving stability and most accurate mesh openings.

The twill weave allows a thicker wire and is suitable for heavy meshes. The wire position twill weave wire mesh is less stable compared with plain weave.

The plain dutch weave is similar to plain weave, while the warp wires are thicker and lie closer to each other. This type of woven wire mesh is mainly used as industrial filter cloth and apparatus of separation.

The five heddle weave has a smooth top surface and an open lower surface. It is ideal to withstand high mechanical strain and excellent filter performance.

Once the barrier 10 has been installed, function of the barrier 10 occurs as follows. When rain strikes the shingles S upon the roof R, the water W travels down off of the shingles S toward the gutter G. The water W will have a tendency to draw debris down the shingles S. Similarly, wind and gravity will tend to draw debris down towards the gutters G. When the water W reaches an edge of the shingles S, it falls off of the shingles S and down onto the barrier 10. Particularly, the water W will either strike portions of the tab 40 just above the screen 20, or pass directly onto the screen 20. In either case, the water W travels downward because the barrier 10 is slightly angled so that the water is traveling toward the lip 70.

Debris entrained with the water W will impact the screen 20 and remain upon the screen 20 or bounce over the upper surface of the screen 20 and fall off of the barrier 10 to the ground. Rain also helps to splash debris off of the screen 20. The water W will wet surfaces of the screen 20. Because the channel 30 includes a recess 50 below the screen 20 and ribs 60 extending up to the screen 20, the water W impacting the screen 20 will, through capillary action and adhesion properties in water molecules, tend to wet all of the surfaces contacting the screen 20, including the ribs 60 extending up from the floor 56 in the recess 50 of the channel 30. Once the ribs 60 have become wetted, a wet path exists all the way down to the floor 56. No surface tension barrier thus exists and the water W is drawn by gravity down through the fenestrations in the screen 20, along surfaces of the ribs 60, and down into the troughs 57 between the ribs 60 on the floor 56 of the recess 50. The apertures 58 allow the water W to fall down through the floor 56 of the recess 50 and into the rain gutter G for collection of the water W and distribution of the water W away from the structure.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A rain gutter debris preclusion barrier, comprising in combination:

a substantially rigid elongate support structure extending between ends thereof and adapted to span the gutter open upper end;

said elongate support structure including holes to allow water to pass therethrough;

said elongate support structure including raised elements that extend up from a lower portion, said holes located below said raised elements;

a pair of slots on said elongate support structure oriented facing each other and spaced from each other by a width of a water collection region above said raised elements and said holes of said elongate support structure;

an elongate screen extending between screen ends thereof and resting upon said raised elements with opposite edges of said screen located within each of said pair of slots, said screen being porous to allow water flow therethrough;

a seam separating one said end of said support structure and one said end of said screen from an end of a separate, adjacent, elongate support structure and an end of a separate, adjacent screen;

said seam covered by a connecting member;

said connecting member having opposite ends spaced similar to a spacing between said pair of slots;

said opposite ends of said connecting member each located within one of said pair of slots and on top of said screen to cover said seam; and wherein sides of said connecting member extend between said opposite ends, said sides each including a recessed edge portion such that said connecting member is narrower at a midpoint thereof than at ends thereof adjacent said opposite ends.

2. The barrier of claim 1 wherein said connecting member has a friction fit above portions of said screen and within said slots of said support structure.

3. The barrier of claim 1 wherein said connecting member is sufficiently flexible to facilitate insertion of opposite ends of said connecting member into each of said pair of slots while said connecting member is curved, and then flattening said connecting member to fully insert opposite ends of said connecting member into said slots.

4. The barrier of claim 1 wherein said connecting member includes an elongate ridge extending at least partially between said opposite ends and between sides and parallel with sides of said connecting member, said ridge defining a portion of said connecting member raised slightly relative to other portions of said connecting member.

5. The barrier of claim 1 wherein said connecting member includes holes passing therethrough adjacent opposite ends thereof, said holes adapted to receive fasteners passing through said connecting member, through said screen and at least into portions of said support structure to secure said connecting member to said screen and said support structure.

6. The barrier of claim 1 wherein said connecting member has beveled corners, such that insertion of opposite ends of said connecting member into said slots is facilitated.

7. The barrier of claim 1 wherein said connecting member includes a wing in the form of a pair of bends in said connecting member, such that a cross-section of said connecting member at said wing exhibits an inverted "V" shape, said connecting member oriented with said wing extending up from said connecting member.

8. The barrier of claim 7 wherein said connecting member is formed of resilient material, such that when said connecting member is flexed about said wing, said connecting member resiliently returns to a rigid original form when loads are later removed.

9. The barrier of claim 1 wherein said connecting member is in the form of a section of screen having a width between said opposite ends similar to a distance between said pair of slots, with the connecting member providing an overlapping layer of screen overlying said seam.

* * * * *